US011428026B2

(12) United States Patent
Hill

(10) Patent No.: US 11,428,026 B2
(45) Date of Patent: Aug. 30, 2022

(54) PIVOTING MAGNET SECURITY LATCH

(71) Applicant: Carrier Corporation, Jupiter, FL (US)

(72) Inventor: Matthew S. Hill, Aumsville, OR (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 342 days.

(21) Appl. No.: 16/490,354

(22) PCT Filed: Feb. 28, 2018

(86) PCT No.: PCT/US2018/020249
§ 371 (c)(1),
(2) Date: Aug. 30, 2019

(87) PCT Pub. No.: WO2018/160710
PCT Pub. Date: Sep. 7, 2018

(65) Prior Publication Data

US 2020/0002973 A1 Jan. 2, 2020

Related U.S. Application Data

(60) Provisional application No. 62/465,393, filed on Mar. 1, 2017.

(51) Int. Cl.
*E05B 67/00* (2006.01)
*E05B 19/00* (2006.01)
*E05B 47/00* (2006.01)

(52) U.S. Cl.
CPC ..... *E05B 19/0005* (2013.01); *E05B 47/004* (2013.01); *E05B 67/00* (2013.01); *E05B 2047/0094* (2013.01)

(58) Field of Classification Search
CPC .... E05B 19/0005; E05B 47/004; E05B 67/00; E05B 2047/0094; E05C 19/16
(Continued)

(56) References Cited

U.S. PATENT DOCUMENTS 3,596,958 A * 8/1971 Bowerman ..... E05B 47/0038 292/201
3,974,669 A 8/1976 Stackhouse
(Continued)

FOREIGN PATENT DOCUMENTS

FR 2248720 A5 5/1975
FR 3014927 B1 * 12/2016 ..... E05B 47/004
(Continued)

OTHER PUBLICATIONS

International Search Report for International Application No. PCT/US2018/020249, International Filing Date Feb. 28, 2018, dated Jul. 24, 2018, 9 pages.
(Continued)

*Primary Examiner* — Suzanne L Barrett
(74) *Attorney, Agent, or Firm* — Cantor Colburn LLP

(57) ABSTRACT

A locking module (42) for selectively coupling a first component and a second component of a lockable device (20) includes a housing (44) and a locking element (62) movably connected to said housing (44) between a locked position and an unlocked position. A rotatable shaft (46) including a magnet (70) extends into said housing (44). The shaft (46) has an opening (66) complementary to a portion of said locking element (62). A biasing mechanism (64) is coupled to said locking element (62) to bias said locking element (62) towards said locked position. In said unlocked position, said locking element (62) is positioned within said opening (66) in said shaft (46).

16 Claims, 8 Drawing Sheets

(58) Field of Classification Search
USPC ..... 70/20–22, 63; 292/251.5
See application file for complete search history.

(56) References Cited

U.S. PATENT DOCUMENTS

| | | | | |
|---|---|---|---|---|
| 4,628,289 | A | 12/1986 | Huber | |
| 4,766,746 | A * | 8/1988 | Henderson | G07C 9/21 340/5.73 |
| 4,851,652 | A * | 7/1989 | Imran | G06K 7/065 235/382 |
| 4,987,968 | A | 1/1991 | Martus et al. | |
| 5,040,652 | A * | 8/1991 | Fish | E05B 17/0058 70/189 |
| 5,485,733 | A * | 1/1996 | Hoffman | E05B 47/004 70/276 |
| 5,737,947 | A * | 4/1998 | Ling | E05B 19/0005 70/312 |
| 6,075,298 | A | 6/2000 | Maue et al. | |
| 7,076,976 | B1 | 7/2006 | Goldman | |
| 7,125,058 | B2 | 10/2006 | Hawthorne | |
| 8,083,274 | B2 | 12/2011 | Caldwell et al. | |
| 2003/0179075 | A1* | 9/2003 | Greenman | G07C 9/00896 340/5.54 |
| 2004/0226325 | A1* | 11/2004 | Ling | E05G 1/005 70/63 |
| 2006/0049645 | A1* | 3/2006 | Drumm | E05C 19/163 292/251.5 |
| 2006/0213237 | A1* | 9/2006 | Yang | E05B 37/025 70/63 |
| 2008/0047309 | A1 | 2/2008 | Okuno et al. | |
| 2009/0095036 | A1* | 4/2009 | Ng | E05B 37/025 70/63 |
| 2011/0067461 | A1* | 3/2011 | Hacker | E05B 19/0005 70/63 |
| 2012/0291504 | A1* | 11/2012 | Oliana | E05B 47/004 70/452 |
| 2012/0324967 | A1 | 12/2012 | Goren et al. | |
| 2014/0150502 | A1* | 6/2014 | Duncan | E05B 67/14 70/20 |
| 2014/0250954 | A1* | 9/2014 | Buzhardt | G07C 9/00 70/20 |
| 2014/0373578 | A1* | 12/2014 | Chang | E05B 37/0034 70/21 |
| 2016/0049032 | A1* | 2/2016 | Ranchod | E05B 67/22 70/20 |
| 2017/0234038 | A1* | 8/2017 | Sanford | E05B 37/0058 70/63 |

FOREIGN PATENT DOCUMENTS

| | | | | |
|---|---|---|---|---|
| WO | WO-2008038263 | A2 * | 4/2008 | A45C 11/32 |
| WO | WO-2012146882 | A1 * | 11/2012 | E05B 47/0607 |

OTHER PUBLICATIONS

Written Opinion for International Application No. PCT/US2018/020249, International Filing Date Feb. 28, 2018, dated Jul. 24, 2018, 13 pages.

* cited by examiner

PIVOTING MAGNET SECURITY LATCH

CROSS REFERENCE TO RELATED APPLICATIONS

This application is a National Stage application of PCT/US2018/020249, filed Feb. 28, 2018, which claims the benefit of U.S. Provisional Application No. 62/465,393, filed Mar. 1, 2017, both of which are incorporated by reference in their entirety herein.

BACKGROUND

This disclosure relates generally to a lockable device and, more particularly, to a locking module for use in a lockable device.

Lockboxes typically provide a secured storage area for a key or other access aid at a location close to a locked property accessible by the key. In this way, an authorized user can unlock the lockbox to gain access to the secured storage area and then use the key contained therein to unlock the locked property.

The lockbox is typically attached to a door handle or to another stationary object near the traditional lock. The lockbox typically requires the user to demonstrate that he is authorized to obtain access to the locked property before the secured storage area is unlocked to allow the user to obtain the key. In a mechanical lockbox, the user might be required to enter a correct lock combination to access the secured storage area. In an electronic lockbox, the user might be required to communicate a credential to lockbox (via a physical connection to the lockbox or via a wireless link to the lockbox) to access the secured storage area.

SUMMARY

According to one embodiment, a locking module for selectively coupling a first component and a second component of a lockable device includes a housing and a locking element movably connected to said housing between a locked position and an unlocked position. A rotatable shaft including a magnet extends into said housing. The shaft has an opening complementary to a portion of said locking element. A biasing mechanism is coupled to said locking element to bias said locking element towards said locked position. In said unlocked position, said locking element is positioned within said opening in said shaft.

In addition to one or more of the features described above, or as an alternative, in further embodiments in said locked position, a portion of said locking element extends beyond said housing into engagement with said second component.

In addition to one or more of the features described above, or as an alternative, in further embodiments said locking element includes a magnetic material.

In addition to one or more of the features described above, or as an alternative, in further embodiments said magnet is a permanent magnet.

In addition to one or more of the features described above, or as an alternative, in further embodiments comprising a mechanism operably coupled to said shaft.

In addition to one or more of the features described above, or as an alternative, in further embodiments said mechanism is a mechanical mechanism that rotates the shaft in response to a user input.

In addition to one or more of the features described above, or as an alternative, in further embodiments said mechanism is an electromechanical mechanism that rotates the shaft in response to a user input.

According to another embodiment, a locking assembly includes a first locking module for selectively locking a first component to a second component, a second locking module for selectively locking a third component to said second component, and a mechanism associated with both said first locking module and said second locking module. The mechanism is controllable to operate said first locking module and said second locking module independently.

According to yet another embodiment, a method of operating a locking module of a lockable device includes operating a mechanism in response to a user input, rotating a shaft associated with said locking module about an axis between a first position and a second position, moving said locking element from a locked position to an unlocked position, and retaining said locking element in said unlocked position via application of a magnetic field.

In addition to one or more of the features described above, or as an alternative, in further embodiments said magnetic field acts on said locking element in when said shaft is in said second position.

In addition to one or more of the features described above, or as an alternative, in further embodiments a permanent magnet is arranged within said shaft to attract said locking element.

In addition to one or more of the features described above, or as an alternative, in further embodiments rotating said shaft between said second position and said first position and biasing said locking element from said locked position to said unlocked position.

In addition to one or more of the features described above, or as an alternative, in further embodiments said mechanism is operable in response to a mechanical input.

In addition to one or more of the features described above, or as an alternative, in further embodiments said mechanism is operable in response to an electromechanical input.

According to another embodiment, a method of operating a locking assembly includes providing a first locking module associated with a first component, providing a second locking module associated with a second component, providing a mechanism associated with both said first locking module and said second locking module, operating said mechanism in a first mode in response to a user input to unlock said first locking module, and operating said mechanism in a second mode in response to a user input to unlock said second locking module.

In addition to one or more of the features described above, or as an alternative, in further embodiments said first mode includes operating said mechanism in a first direction.

In addition to one or more of the features described above, or as an alternative, in further embodiments said second mode includes operating said mechanism in a second direction, opposite said first direction.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1A:
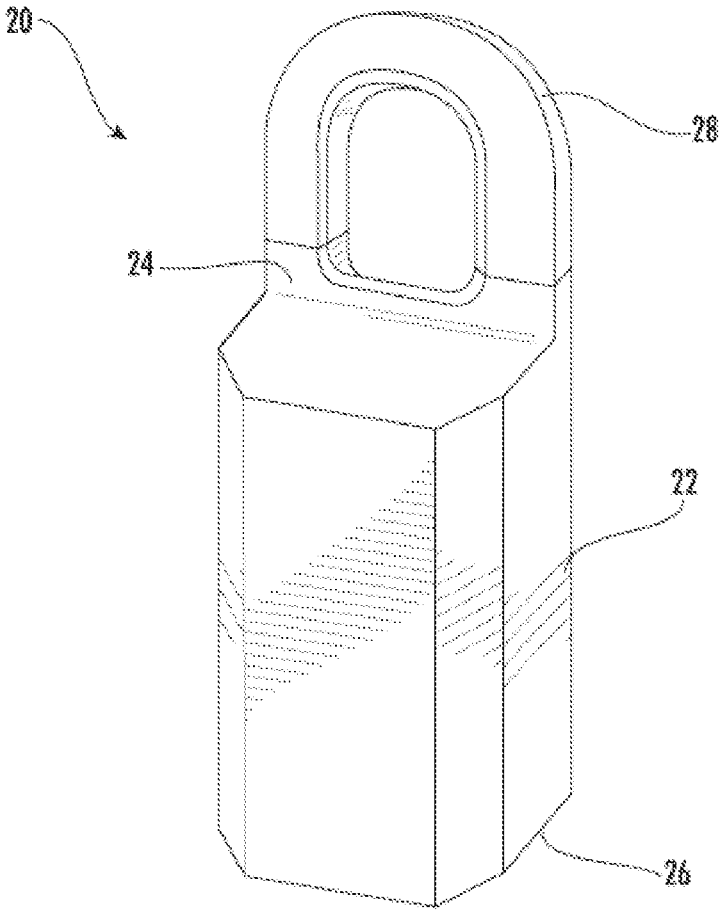
FIG. 1A is a perspective view of an example of a lockable device in a closed configuration.
Figure 1B:
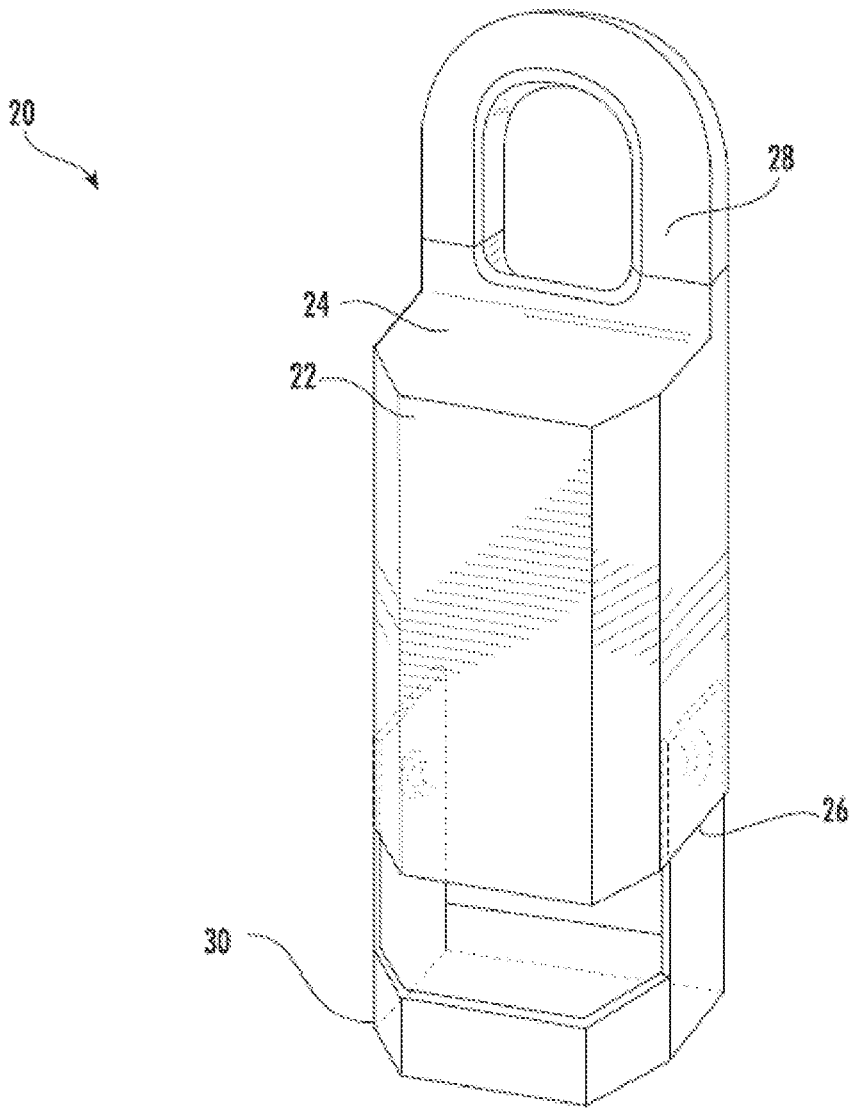
FIG. 1B is a perspective view of an example of a lockable device having a keybox in an extended position.
Figure 2:
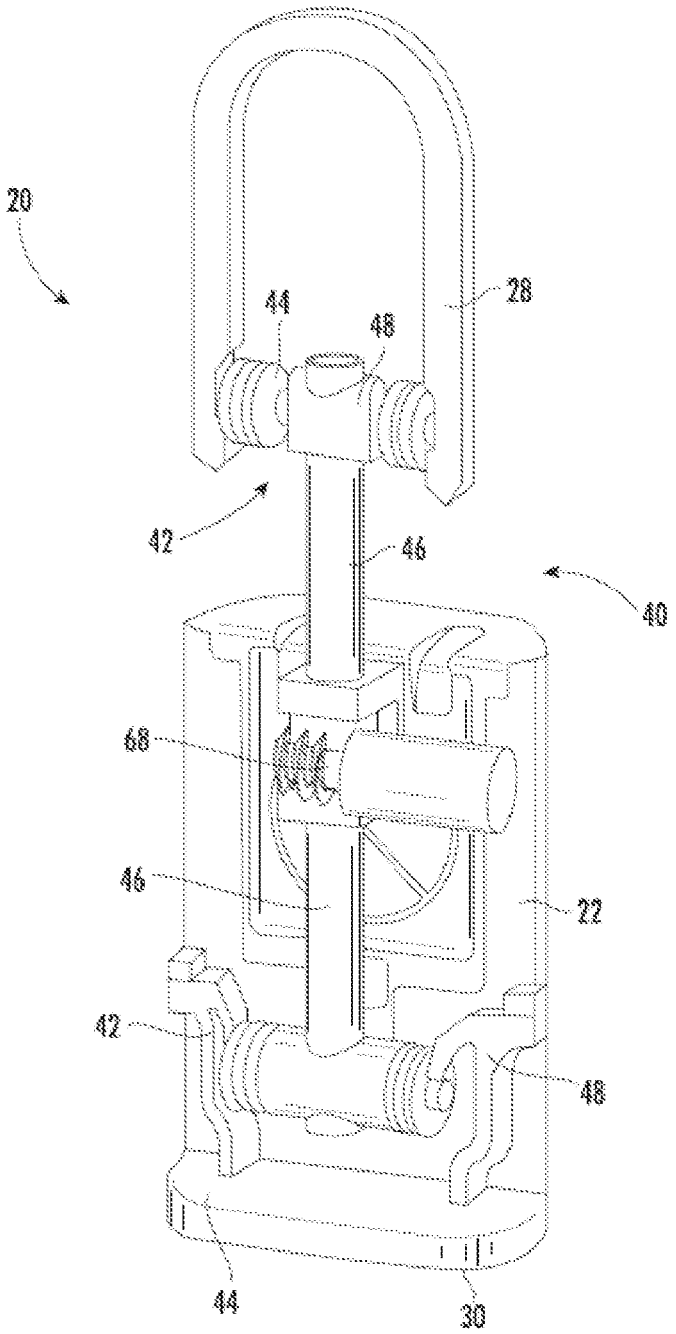
FIG. 2 is a perspective view of a locking assembly associated with a lockable device according to an embodiment.

Referring now to FIGS. 1A and 1B, an example of a lockable device 20, such as a lockbox is illustrated. The lockbox 20 includes a body 22 and one or more components movable relative to the body 22. For example, the lockbox 20 additionally includes a shackle 28 positioned adjacent a first end 24 of the body 22 and a keybox 30 (best shown in FIG. 1B) positioned adjacent a second, opposite end 26 of the body 22. The shackle 28 may be configured to translate and/or rotate relative to the body 22. Alternatively, or in addition, the keybox 30 may be configured to translate relative to the body 22. In an embodiment, at least one of the shackle 28 and the keybox 30 is separable from the body 22.

A locking assembly 40 is operable to selectively couple a first component and a second component. In an embodiment, when applied to a lockable device, such as lockbox 20 for example, the locking assembly 40 selectively locks the shackle 28 to the body 22. Accordingly, the locking assembly 40 restricts movement of the lockbox 20 once arranged in a desired location via the shackle 28. Alternatively or in addition, the locking assembly 40 may be used to selectively lock the keybox 30 to the body 22. In such instances, operation of the locking assembly 40 may provide an authorized user with access to the internal cavity of the keybox 30, within which one or more items, such as a key for example, may be stored.

With reference now to FIG. 2-5B, the locking assembly 40 configured to selectively couple at least one of the shackle 28 and the keybox 30 to the body 22 of a lockbox 20 is illustrated in more detail. As shown, the locking assembly 40 includes at a first locking module 42, associated with the shackle 28 and a second locking module 42 associated with the keybox 30. However, embodiments including only a single locking module 42 are also contemplated herein. The locking module 42 includes a generally hollow housing 44. A rotatable shaft 46 is receivable within an opening 48 formed in the exterior surface of the housing 44. In the illustrated, non-limiting embodiment, the shaft 46 is oriented substantially perpendicular to the longitudinal axis of the housing 44. However embodiments where the shaft 46 and the housing 44 have another orientation are within the scope of the disclosure.

Located within the hollow interior 50 of the housing 44 is a retaining member 52 through which the shaft 46 extends. The retaining member 52 is aligned with and/or coupled to a spacer 54 arranged within the hollow interior 50 of the housing 44, generally adjacent a corresponding end 56, 58 thereof. A passage 60 extends from the ends 56, 58 of the housing 44, through the spacer 54 and the retaining member 52. A locking element 62, such as a plunger for example, is movably mounted within this passage 60 and a biasing mechanism 64 is mounted concentrically with the locking element 62. A biasing force of the biasing mechanism 64 is configured to bias the locking element 62 away from the shaft 46, towards a locked position. In an embodiment, the locking element 62 is formed from or includes any suitable magnetic material. In some embodiments, a suitable magnetic material includes a composite magnetic material, or alternatively, may include a non-magnetic material having a separate magnetic component or material attached to a portion thereof.

An opening 66 corresponding to a portion of each locking element 62 is formed in a portion of the shaft 46. The shaft 46 is rotatable rotated between a first position (FIG. 5A) and a second position (FIG. 5B) to control movement of the locking plunger 62. When the shaft 46 is in the first position, the opening 66 is not aligned with a corresponding passage 60. As a result, the locking plunger 62 is blocked from moving towards the shaft 46 and out of engagement with a corresponding portion of either the keybox 30, or the shackle 28. When the shaft 46 is in the second position, the opening 66 and the passage 60 are aligned, such that the locking plunger 62 can translate to a position engaged with the shaft 46. In this position, the locking plunger 62 does not restrict movement of the keybox 30, or the shackle 28.

The shaft 46 is configured to rotate about its axis in response to operation of a mechanism, illustrated schematically at 68, operably coupled thereto. The mechanism 68 for rotating the shaft 46 may be mechanically operated by a user, or alternatively, may include an electromechanical mechanism, such as a motor, solenoid, or a piezoelectric device for example, directly or indirectly coupled to the shaft 46. In such embodiments, the mechanism 68 may be operable in response to an electrical input, such as generated by a code entered via a key pad or upon detection of an identification device, such as an RFID tag for example, having acceptable credentials.

In operation, a user provides an input to operate the mechanism 68 associated with shaft 46. In response to the input, the mechanism 68 drives rotation of the shaft 46 about its axis between a first position and a second position. In the second position, the opening 66 is aligned with a corresponding passage 60. Arranged within the interior of the shaft 46, adjacent the opening 66, is a permanent magnet, illustrated schematically at 70. In an embodiment, when the opening 66 and a corresponding passage 60 are aligned, the magnetic force of the permanent magnet 70 acts on the locking plunger 62 causing the locking plunger 62 to translate against the biasing force of the biasing mechanism 64. This magnetic force causes the plunger 62 to move from a locked position, where a portion of the locking plunger 62 is arranged within the path of movement of the shackle 28 or keybox 30 relative to the body, to an unlocked position, to a position out of engagement with the shackle 28 or keybox 30 such that the shackle 28 or keybox 30 is freely movable relative to the locking module 42 and the body 22.

In an alternative embodiment, the interior of the keybox is formed with a ramp surface 72 positioned generally adjacent to a corresponding plunger 62. After authentication and rotation of the shaft about its axis to the second position, a force is applied to the keybox 30. As the keybox moves in response to the force, the ramp surface engages an end of the plunger 62, causing the plunger to move towards the shaft 66. In the illustrated, non-limiting embodiment, the ramp surface is designed to apply a normal force to the plunger. However, other configurations of the ramp surface are also contemplated herein. To reconnect the shackle 28 or keybox 30 to the body 22, the mechanism 68 is operated to rotate the shaft 46 back to a first position. As the openings 66 move out of alignment with the passages 60, the magnetic force acting on the locking plungers 62 is reduced. As a result, the biasing force of the biasing mechanism 64 biases the locking plungers 62 through the passage 60 to the locked position.

Figure 6:
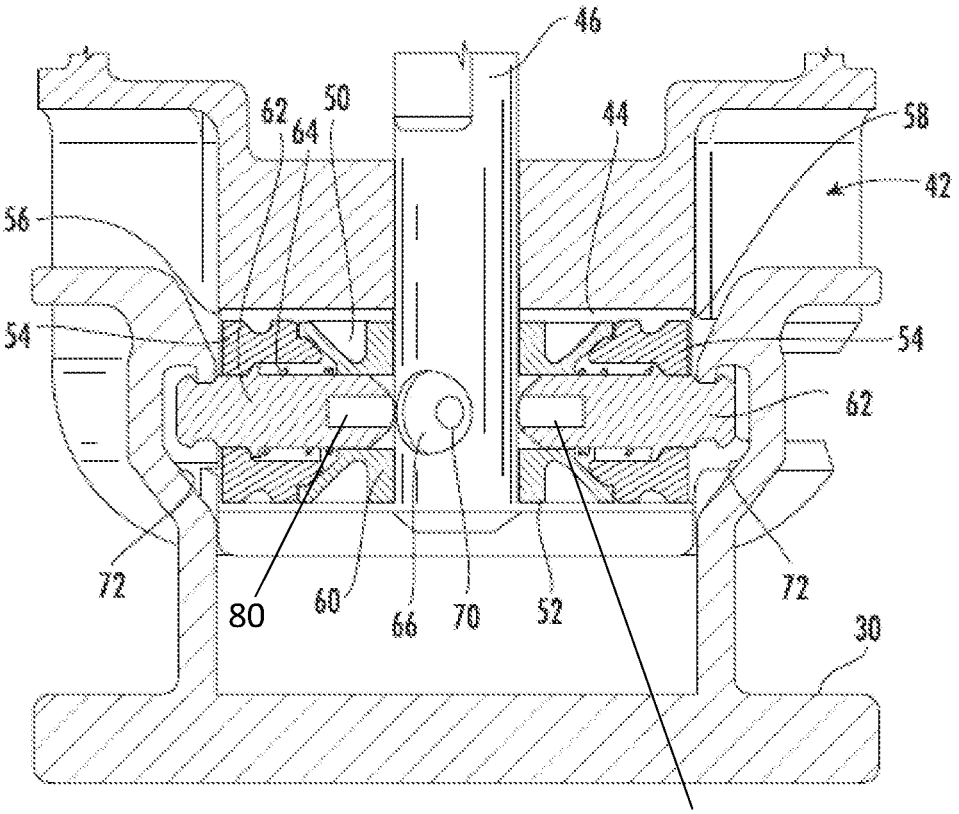
FIG. 6 is a cross-sectional view of a locking module according to another embodiment
Figure 7A:
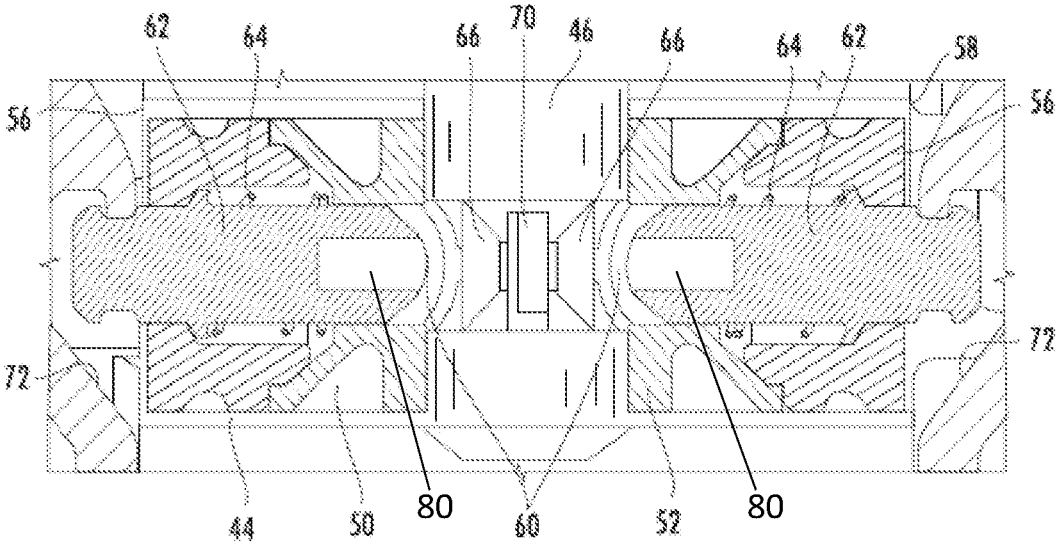
FIG. 7A is a cross-sectional view of the locking module of FIG. 6 when decoupling two components associated via the locking module according to an embodiment.
Figure 7B:
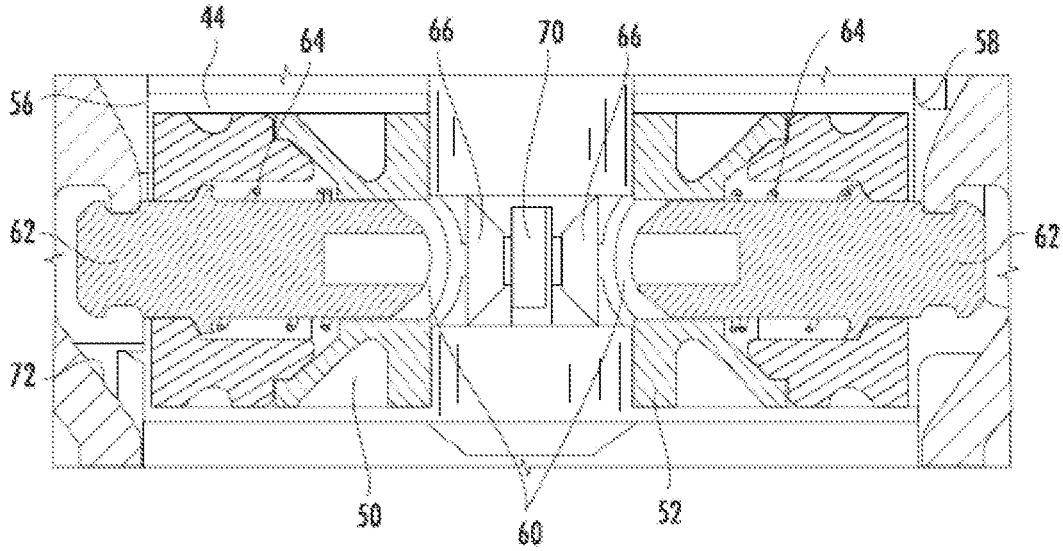
FIG. 7B is a cross-sectional view of the locking module of FIG. 6 when recoupling two components associated via the locking module according to an embodiment.

In another embodiment of the locking module 42, illustrated in FIGS. 6, 7A, and 7B a magnet 80 is coupled to or embedded within a portion of each locking plunger 62 adjacent the shaft 66. The magnets 80 are configured to cooperate with the magnet 70 within the shaft 66 to move the locking plungers 62 in and out of engagement with a corresponding component, such as the keybox 30 for example.

To operate the latch and decouple the components 22, 30, a user provides an input to operate the mechanism 68 associated with shaft 46. In response to the input, the mechanism 62 drives rotation of the shaft 46 about its axis to an open position where the openings 66 are aligned with a corresponding passage 60. In this open position, the poles of the magnet 70 positioned within the shaft 46 are opposite the poles of the adjacent magnets 80 associated with the locking plungers 62. As the locking plungers 62 move toward the shaft 46, the attraction between the magnets 70, 80 holds the locking plunger 62 against the biasing force of the biasing mechanism 64, and within opening 66. Upon removal of the keybox 30, the shaft 46 is rotated to a position where the openings 66*s* are misaligned with the locking plungers 62.

To reconnect the couple to the body 22 via the locking module 42, the shaft is again rotated about its axis to a position where the openings 66 and the locking plungers are aligned. However, during insertion of the keybox 30, the poles of the magnet 70 are substantially identical to the poles of the adjacent magnets of the locking plungers 62. As the keybox is reinstalled, the force applied by the ramp surface 72 to the locking plungers 62 causes the locking plungers 62 to translate within the passage 60 towards the shaft 46, opposite the biasing force. As a result of the relative positioning of the magnets 70, 80 when the locking plungers 62 are within proximity to the shaft, the magnets 70, 80 will repel. Further, the biasing force of the biasing mechanism 64 will bias the locking plungers 62 through the passage 60 to the locked position to restrict movement of the keybox relative to the body 22.

Figure 3:
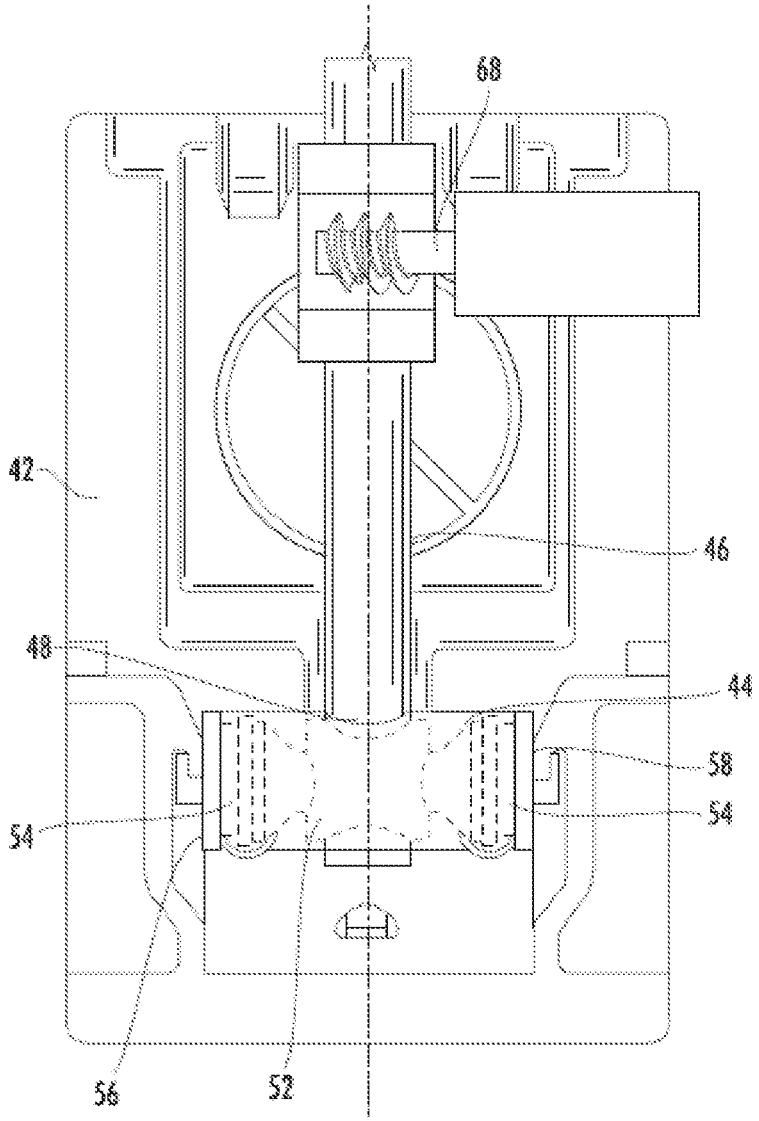
FIG. 3 is a front view of a locking module of the locking assembly according to an embodiment.
Figure 4:
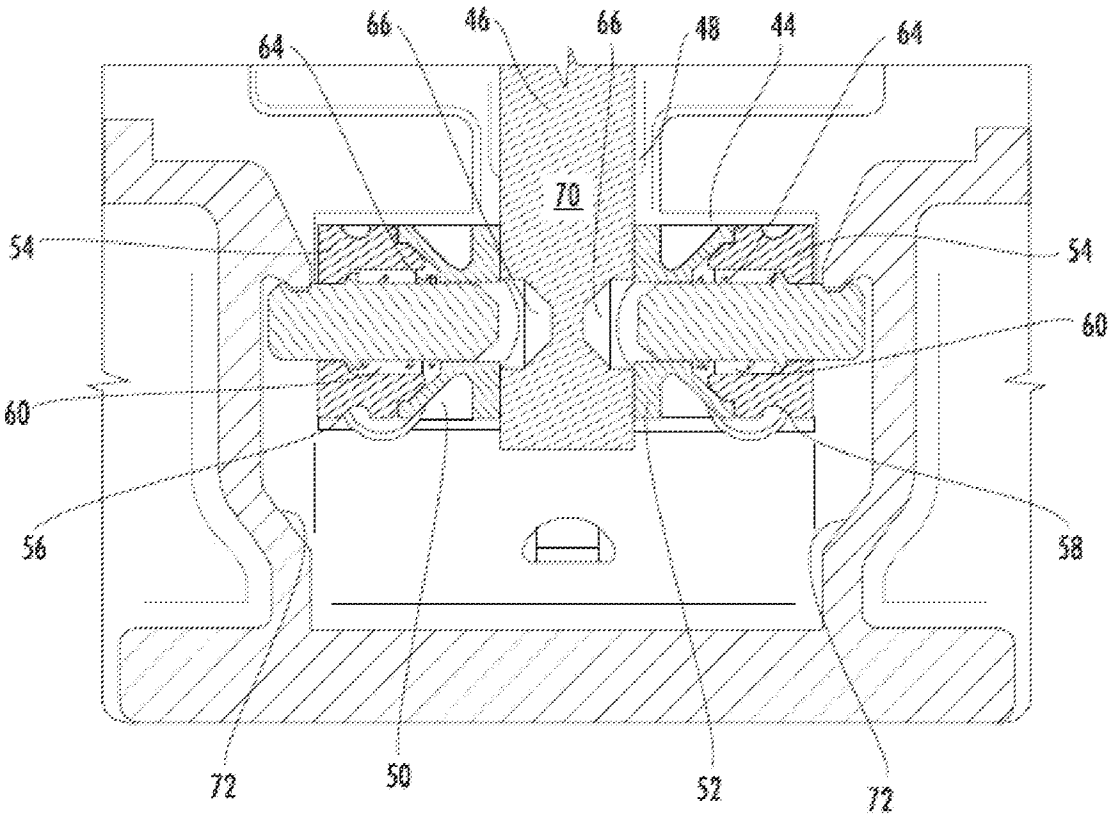
FIG. 4 is a cross-sectional view of the locking module of FIG. 3 according to an embodiment.
Figure 5A:
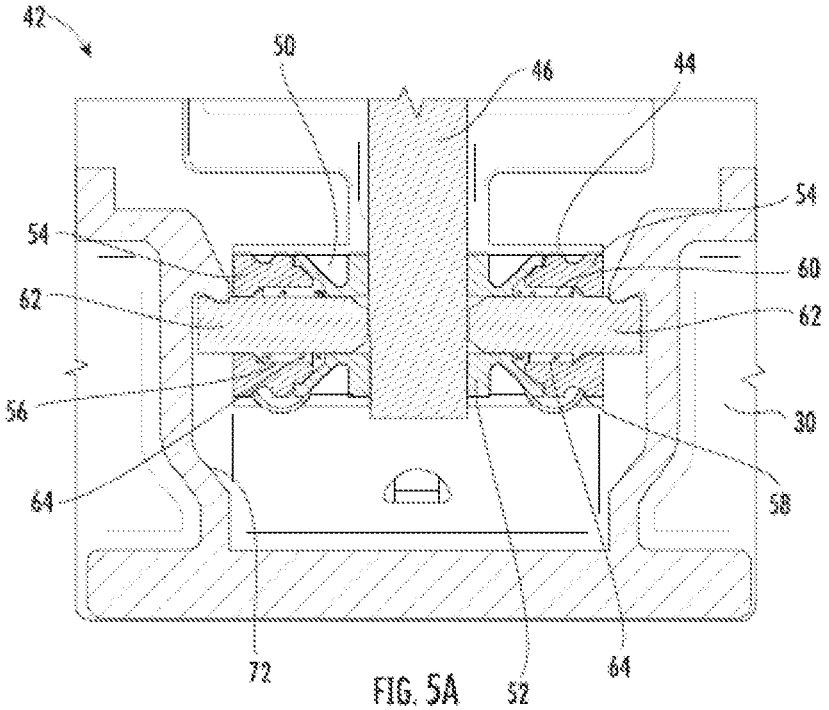
FIGS. 5A and 5B are cross-sectional views of a locking module in a locked position and an unlocked position according to an embodiment.
Figure 5B:
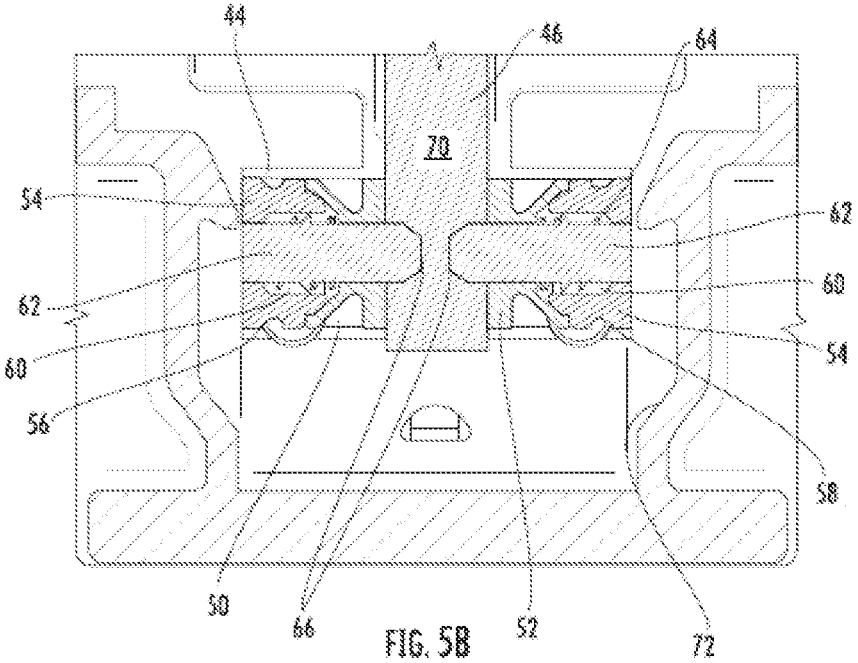

Each locking module 42 of the locking assembly 40 may be associated with a separate mechanism 68. Alternatively, in an embodiment, as shown in FIGS. 3 and 4, a single mechanism 68 may be used to operate multiple locking modules 42 of a locking assembly 40. Depending on the configuration of the shafts 46, the locking modules 42 may be operated either simultaneously or independently. For example, in embodiments where the locking modules 42 are operated independently, operation of the mechanism 68 in a first direction may drive the shaft 46 associated with a first locking module between the first and second positons, and operation of the mechanism in a second, opposite direction may drive the shaft associated with a second locking module. Alternatively, a single shaft 46 may be used to operate the plurality of locking modules. For example, the configurations of a magnet 70 embedded within each end of the shaft 46 may be opposite, such that when the locking plungers 62 of one of the locking modules 42 is attracted to the shaft 46, the locking plungers of another locking module 42 is repelled away from the shaft 46.

The locking module 42 illustrated and described herein has a simplified configuration resulting in a reduced cost. Further, the compact design of the locking module 42 eliminates the space required within the body 22. In addition, the locking module 40 is energy efficient by requiring limited movement to lock and unlock the module 40.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed:

1. A locking module for selectively coupling a first component and a second component of a lockable device comprising:

a housing;

a locking element movably connected to said housing between a locked position and an unlocked position, said locking element including a magnetic material;

a rotatable shaft including a magnet extending into said housing, said shaft having an opening complementary to a portion of said locking element;

a biasing mechanism coupled to said locking element to bias said locking element towards said locked position;

wherein in said unlocked position, said locking element is received within said opening in said shaft in response to a magnetic force of said magnet acting on said locking element.

2. The locking module of claim 1, wherein in said locked position, a portion of said locking element extends beyond said housing into engagement with said second component.

3. The locking module of claim 1, wherein said magnet is a permanent magnet.

4. The locking module of claim 1, further comprising a mechanism operably coupled to said shaft.

5. The locking module of claim 4, wherein said mechanism is a mechanical mechanism that rotates the shaft in response to a user input.

6. The locking module of claim 4, wherein said mechanism is an electromechanical mechanism that rotates the shaft in response to a user input.

7. A locking assembly comprising:

a first locking module for selectively locking a first component to a second component;

a second locking module for selectively locking a third component to said second component;

at least one shaft operably coupled to the first locking module and the second locking module; and a mechanism operably coupled with the at least one shaft, said mechanism being controllable to operate said first locking module and said second locking module independently.

8. A method of operating a locking module of a lockable device comprising:

operating a mechanism in response to a user input;

rotating a shaft associated with said locking module about an axis between a first position and a second position;

moving a locking element from a locked position to an unlocked position, wherein in the unlocked position, said locking element is at least partially arranged within an opening formed in said shaft; and retaining said locking element in said unlocked position via application of a magnetic field.

9. The method of claim 8, wherein said magnetic field acts on said locking element is-when said shaft is in said second position.

10. The method of claim 9, wherein a permanent magnet is arranged within said shaft to attract said locking element.

11. The method of claim 9, further comprising:

rotating said shaft between said second position and said first position; and biasing said locking element from said locked position to said unlocked position.

12. The method of claim 9, wherein said mechanism is operable in response to a mechanical input.

13. The method of claim 9, wherein said mechanism is operable in response to an electromechanical input.

14. A method of operating a locking assembly comprising:

providing a first locking module associated with a first component;

providing a second locking module associated with a second component;

providing at least one shaft operably coupled to the first locking module and the second locking module;

providing a mechanism coupled to the at least one shaft;

operating said mechanism in a first mode in response to a user input to unlock said first locking module; and operating said mechanism in a second mode in response to a user input to unlock said second locking module.

15. The method of claim 14, wherein said first mode includes operating said mechanism in a first direction.

16. The method of claim 15, wherein said second mode includes operating said mechanism in a second direction, opposite said first direction.

* * * * *